United States Patent [19]

Fisher

[11] Patent Number: 4,931,805

[45] Date of Patent: Jun. 5, 1990

[54] ADHESIVE SYSTEM AND METHOD FOR MOUNTING A CELLULAR TELEPHONE ANTENNA

[75] Inventor: Roger K. Fisher, Mundelein, Ill.

[73] Assignee: The Antenna Company, Countryside, Ill.

[21] Appl. No.: 194,469

[22] Filed: May 16, 1988

[51] Int. Cl.[5] ..... H01Q 1/32

[52] U.S. Cl. ..... 343/715; 343/713

[58] Field of Search ..... 343/711, 712, 713, 714, 343/715

[56] References Cited

U.S. PATENT DOCUMENTS

| | | | |
|---|---|---|---|
| 3,618,102 | 11/1971 | Dickason | 343/713 |
| 4,238,799 | 12/1980 | Parfitt | 343/715 |
| 4,621,243 | 11/1986 | Harada | 343/715 |
| 4,658,259 | 4/1987 | Blaese | 343/715 |
| 4,758,166 | 7/1988 | Bonnett et al. | 343/712 |

FOREIGN PATENT DOCUMENTS

| | | | |
|---|---|---|---|
| 0137391 | 4/1985 | European Pat. Off. | 343/715 |
| 3410950 | 9/1985 | Fed. Rep. of Germany | 343/715 |

OTHER PUBLICATIONS

Installation Instructions for Window Mount Antenna, The Antenna Specialists, Cleveland, Ohio, 4–85.

*Primary Examiner*—Andrew J. James
*Assistant Examiner*—Doris J. Johnson
*Attorney, Agent, or Firm*—Lockwood Alex Fitzgibbon & Cummings

[57] ABSTRACT

A window-mounted cellular mobile telephone antenna and method of installation includes an outside coupling module for mounting on the outside surface of a vehicle window in registration with an inside coupling module mounted on the inside surface of the window. The outer coupling module includes a metallic base having a contoured portion for pivotally mounting a vertical radiating element, and a generally flat window engaging portion for engaging the window glass. A peripheral channel formed on the engaging portion defines a central engaging surface. An adhesive layer applied to the engaging surface engages the surface of the glass when the base is positioned on the glass for use. A bead of silicone adhesive in the channel expands against the glass to protect the adhesive layer from exposure to water and contaminants.

18 Claims, 2 Drawing Sheets

FIG. 3
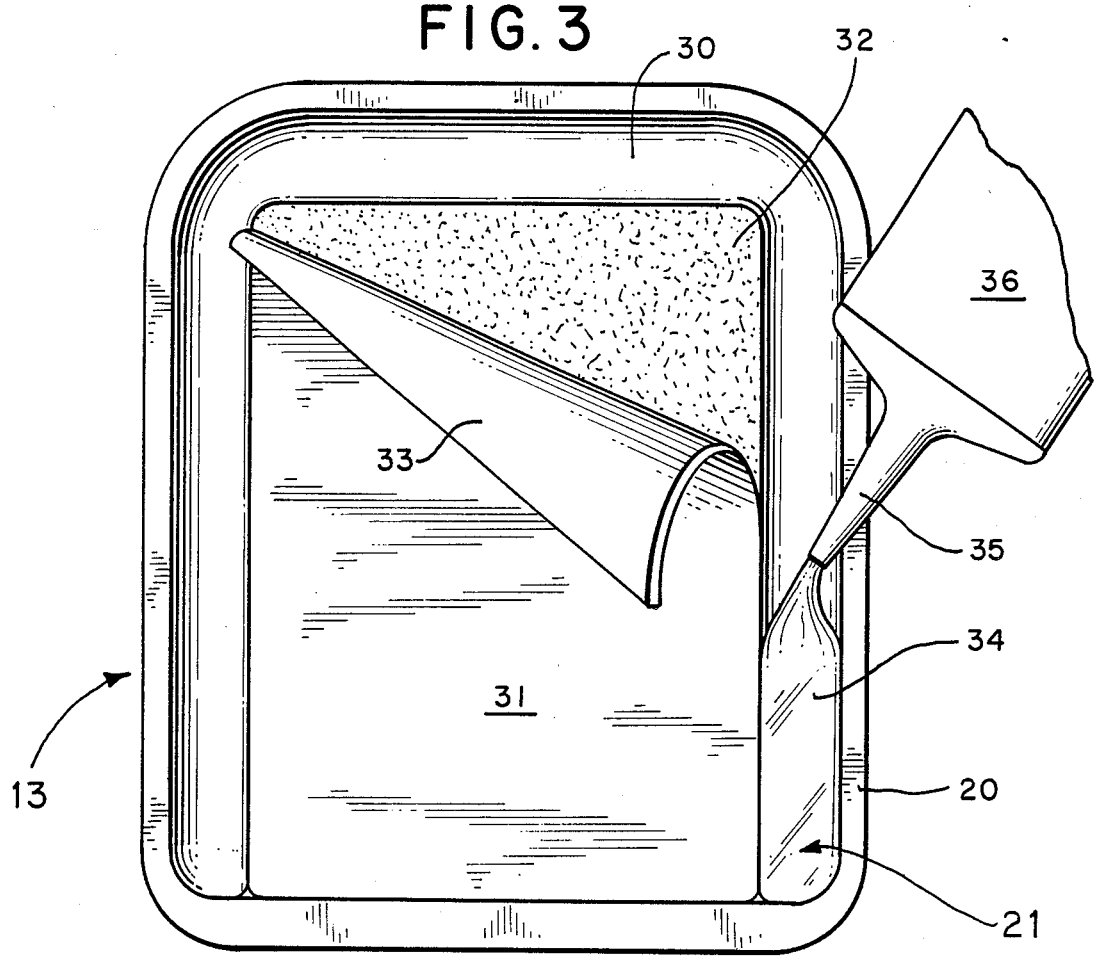
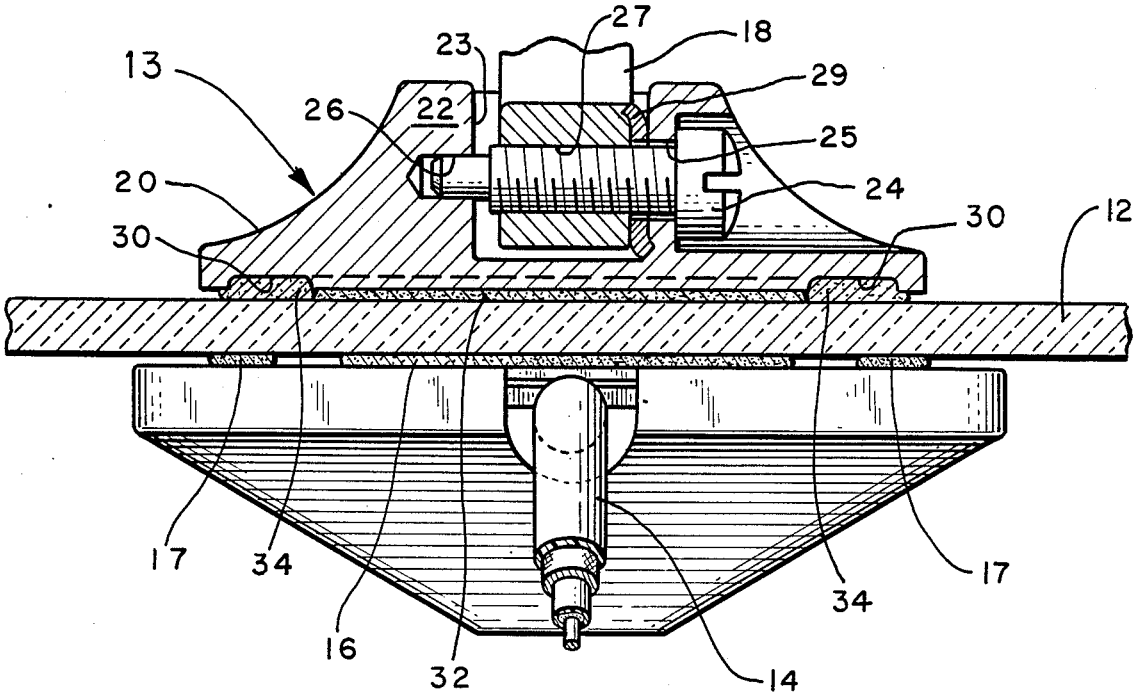
FIG. 4

ADHESIVE SYSTEM AND METHOD FOR MOUNTING A CELLULAR TELEPHONE ANTENNA

SUMMARY OF THE INVENTION

The present invention is directed generally to antennas, and more specifically to a window-mounted vehicle antenna and an improved outside coupling unit

BACKGROUND OF THE INVENTION

With the advent of cellular mobile telephones the need has arisen for antennas which mount on the window of a vehicle, thereby avoiding the need to drill holes in or otherwise modify the vehicle body. Preferably, such window-mounted antennas should offer a degree of performance comparable with body mounted antennas and should be economical to manufacture and easy to install.

One problem often encountered with such window-mounted antennas, which typically include an inside coupling unit connected to a coaxial feedline and an outside coupling unit on which a rod-shaped radiating element is mounted, is securing the outside unit to the outside surface of the window glass. The coupling unit must not only remain secure under adverse conditions of moisture, contamination, temperature and vibration, but also must be economical to manufacture and install.

The present invention provides a new and improved construction for an antenna coupling unit which offers both improved tolerance to adverse environmental conditions and improved ease of installation.

SUMMARY OF THE INVENTION

To these ends, the present invention is directed to an outside coupling unit for a window-mounted antenna which comprises a base including a window engaging portion and a radiating element mounting portion, a radiating element attached to the radiating element mounting portion, and a channel extending around a substantial portion of the periphery of the window engaging portion and defining a generally flat window engaging surface thereon. An adhesive layer overlying a substantial portion of the window engaging surface is provided for adhesively securing the engaging surface to the outside surface of the window. A bead of silicone material is provided in the channel for forming a seal between the base and the outside surface to protect the adhesive layer.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

1 is a perspective view of a window-mounted mobile telephone antenna constructed in accordance with the invention.

FIG. 3 is an enlarged bottom view of the outside coupling unit showing the principal window engagement elements prior to and during installation on a vehicle window.

FIG. 4 is a top plan view of the antenna installed on a vehicle window with the outside coupling unit of the antenna partially in section to show the mounting particulars of the antenna radiating element.

DESCRIPTION OF THE PREFERRED EMBODIMENT

Figure 1:
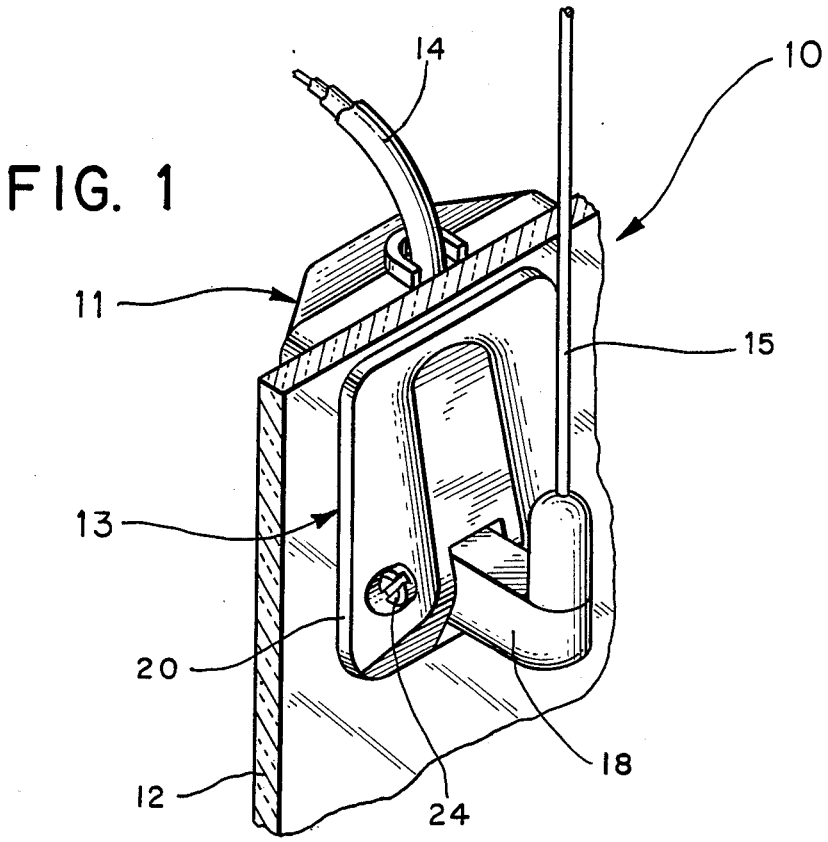

Referring to the Figures, and particularly to FIG. 1, a mobile telephone antenna 10 constructed in accordance with the invention for use in an 800 MHz cellular communications system or the like comprises generally an inside coupling unit 11 for mounting on the inside surface of a vehicle window glass 12, and an outside coupling unit 13 for mounting in registration with the inside coupling unit on the outside surface of the glass. In accordance with conventional practice, RF signals are conveyed to and from the inside coupling unit by a coaxial feedline 14, and RF energy is radiated from the outside coupling unit 13 by a generally vertical radiating element 15.

The inside coupling unit 11, which may be advantageously constructed as described in the copending application of Blake A. Wunderlich, entitled "Improved Antenna for a Cellular Mobile Telephone", Ser. No. 194,466, filed concurrently herewith, may be attached to window 12 by a conventional adhesive layer 16 formed from a length of double-sided adhesive tape or the like, and a plurality of dabs 17 of epoxy or other bonding material, as shown in FIG. 4. Since the inside coupling unit is ordinarily not exposed to weather, no special precautions are necessary for protecting adhesive layer 16.

Referring to FIGS. 3 and 4, the outside coupling unit 13 includes a generally rectangular base 20 having a generally flat window engaging portion 21 (FIG. 3) and a generally contoured raised radiating element receiving portion 22 (FIG. 4). The antenna radiating element 15 includes a right-angle base member 18 which is mounted within a notch-shaped recess 23 provided in portion 22 by means of a machine screw 24 extending through cross-bores 25 and 26 provided in the base. Screw 24 is threaded into a bore 27 on element 15 and provided with a concentric lock washer 28 so that the radiating element can be fixedly secured relative to base 20 by tightening screw 24.

Figure 2:
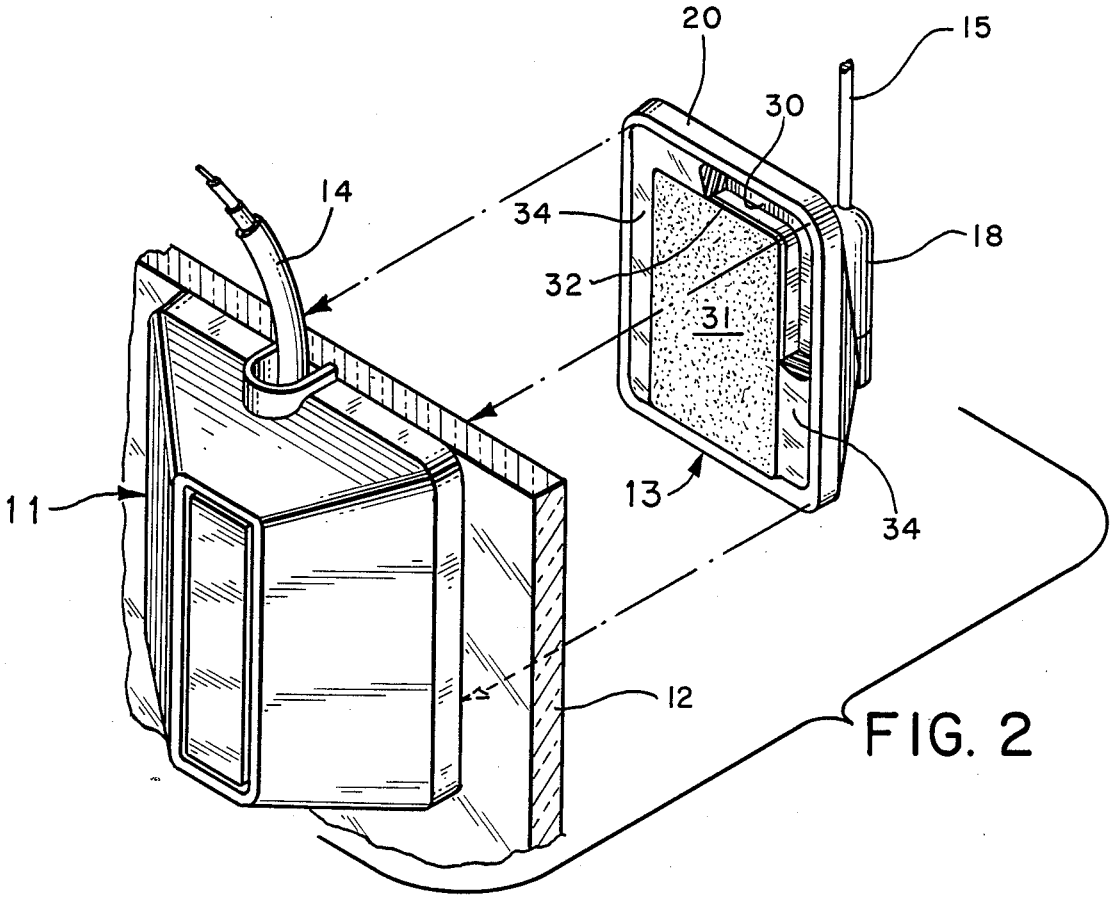
FIG. 2 is an exploded perspective view, partially fragmented, showing the principal window engagement elements of the outside coupling module of the antenna.

Referring to FIGS. 2 and 3, the window engaging portion 21 of base 20 includes, in accordance with the invention, channel 30 which extends around a U-shaped portion of the periphery of the engaging portion to form a flat central glass engaging surface surrounded on its top and sides by the channel. An adhesive layer 32 preferably in the form of a conventional double-sided adhesive tape is provided on all or a substantial portion of this surface to facilitate attachment of coupling unit 13 to the window. A protective peel-back non-adhesive layer 33 is preferably provided over the exposed adhesive surface of layer 32 to protect the layer prior to installation.

To protect adhesive layer 32 from moisture, water, or contaminants which might with time cause deterioration of the layer and consequential failure of the attachment to the window glass, a bead 34 of silicone adhesive gel is deposited in channel 30 prior to engaging the exposed adhesive surface of adhesive layer 32 to the surface of window 12. The silicone adhesive, which does not solidify or set-up with time, is pressed against the outside surface of window 12 by the adherence of adhesive layer 32 and in expanding forms a water-tight seal around the encircled sides of the layer. This serves to protect adhesive layer 32 from deleterious exposure to water and contaminants.

For most effective protection, it is preferable that base 20 be orientated so that channel 30, and hence silicone bead 34, encircles the top and side edges of adhesive layer 32. This gives protection from rain running down the window, while allowing for insertion of a screwdriver or similar prying tool from the bottom edge when removing the unit from the window.

To install outside coupling unit 13, the backing paper 33 is removed to expose the adhesive surface of layer 32. Next, the bead 34 of silicone material is deposited in channel 30, preferably from the nozzle 35 of a conventional tube 36 of the material. Then, after aligning the unit with inside coupling unit 11 the exposed adhesive surface of layer 32 is pressed against glass 12 until base 20 is firmly secured to the glass. As the adhesive surface makes contact, silicone bead 34 expands against the glass to form a water-tight seal which protects adhesive layer 32 and helps to hold base 20 in position.

The base 20 is preferably cast or otherwise formed from an electrically conductive metal such as zinc or aluminum to which an appropriate urethane paint finish may be applied. While various types of adhesives and sealants may be used, the adhesive layer may be advantageously formed by Type 4949 double-sided tape manufactured by 3-M Corporation, and the sealing bead may be advantageously formed from Type 730 RTV Silicone (trademark of Dow Corporation) material.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. An outside coupling unit for a window-mounted antenna, said coupling unit comprising:

a base member including a flat window engaging surface and a radiating element mounting portion;

a radiating element attached to said radiating element mounting portion;

said base member including a channel integrally formed on said window engaging surface and extending around at least a substantial portion of the periphery of said window engaging surface to at least partially encircle a central adhesion portion thereof;

an adhesive layer overlying at least a substantial portion of said central adhesion portion for adhesively securing said adhesion portion to the outside surface of the window; and a bead of silicone material deposited in said channel for forming when brought into contact with said outside surface a seal between said base member and said outside surface to protect said adhesive layer from the environment of the outside coupling unit.

2. A coupling unit as defined in claim 1 wherein said adhesive layer comprises a double-sided adhesive tape having a peel-off protective layer.

3. A coupling unit as defined in claim 2 wherein said tape conforms in dimension to said window engaging surface.

4. A coupling unit as defined in claim 1 wherein said window engaging portion is generally rectangular in dimension, and said channel extends around a U-shaped portion of the periphery thereof to encircle three sides of said central adhesion surface.

5. A coupling unit as defined in claim 4 wherein said unit is orientated such that said U-shaped portion extends generally along the top and sides of said window engaging portion.

6. A coupling unit as defined in claim 5 wherein said adhesive layer comprises a double-sided adhesive tape having a peel-off protective layer.

7. A coupling unit as defined in claim 6 wherein said tape conforms in dimension to said window engaging surface.

8. An antenna for mounting on the window of a vehicle, comprising:

an inside coupling unit having a flat window engaging surface for engaging the inside surface of the window;

an outside coupling unit comprising a base member having a flat window engaging surface adapted to engage said window in general registration with said window engaging surface of said inside coupling unit, and a radiating element mounting portion;

a radiating element attached to said radiating element mounting portion;

said base member including a channel integrally formed on said window engaging surface and extending around at least a substantial portion of the periphery of said window engaging surface to at least partially encircle a central adhesion portion thereof;

an adhesive layer overlying at least a substantial portion of said central adhesion portion for adhesively securing said adhesion portion to the outside surface of the window; and a bead of silicone material deposited in said channel for forming when brought into contact with said outside surface a seal between said base member and said outside surface to protect said adhesive layer from the environment of the outside coupling unit.

9. An antenna as defined in claim 8 wherein said adhesive layer comprises a double-sided adhesive tape having a peel-off protective layer.

10. An antenna as defined in claim 9 wherein said tape conforms in dimension to said window engaging surface.

11. An antenna as defined in claim 8 wherein said window engaging portion is generally rectangular in dimension and said channel extends around a U-shaped portion of the periphery thereof to encircle three sides of said central adhesion surface.

12. An antenna as defined in claim 11 wherein said unit is orientated such that said U-shaped portion extends generally along the top and sides of said window engaging portion.

13. An antenna as defined in claim 12 wherein said adhesive layer comprises a double-sided adhesive tape having a peel-off protective layer.

14. An antenna as defined in claim 13 wherein said tape conforms in dimension to said window engaging surface.

15. The method of mounting the outside coupling unit of a window-mounted antenna, comprising the steps of:

providing a base member having a flat window engaging surface and a radiating element mounting portion, said base member having integrally formed therein on said window engaging surface a channel extending around at least a substantial portion of said surface to at least partially encircle a central adhesion portion thereof;

providing an adhesive layer on at least a substantial portion of said central adhesion portion;

depositing a bead of silicone sealant in said channel; and securing said central adhesion portion to the outside surface of said window whereby said base member is fixedly positioned thereon and said sealant deposited in said channel is caused to contact said outside surface to form a protective seal for said adhesive layer from the environment of the outside coupling unit.

16. The method defined in claim 15 wherein said window engaging portion of said base is generally rectangular in dimension and said channel extends around a generally U-shaped portion of the circumference thereof to encircle three sides of said central adhesion surface.

17. The method defined in claim 16 including the additional step of orientating the outside coupling unit during securing to the window such that the channel extends along the top and sides of said window engaging portion.

18. The method defined in claim 15 wherein the adhesive layer comprises a two-sided adhesive tape having a peel-off protective layer, and the step of providing said adhesive layer comprises peeling off said protective layer.

* * * * *